US007575694B2

(12) United States Patent
Kool et al.

(10) Patent No.: US 7,575,694 B2
(45) Date of Patent: Aug. 18, 2009

(54) METHOD OF SELECTIVELY STRIPPING A METALLIC COATING

(75) Inventors: Lawrence Bernard Kool, Clifton Park, NY (US); Stephen Francis Rutkowski, Duanesburg, NY (US)

(73) Assignee: General Electric Company, Schenectady, NY (US)

( * ) Notice: Subject to any disclaimer, the term of this patent is extended or adjusted under 35 U.S.C. 154(b) by 230 days.

(21) Appl. No.: 11/306,477

(22) Filed: Dec. 29, 2005

(65) Prior Publication Data

US 2007/0151948 A1 Jul. 5, 2007

(51) Int. Cl.
*C23F 1/00* (2006.01)
*C03C 15/00* (2006.01)
*B44C 1/22* (2006.01)

(52) U.S. Cl. ..... 216/102; 216/41; 216/83; 216/103; 216/104; 134/3; 148/247; 427/140; 427/142

(58) Field of Classification Search ..... 216/41, 216/100, 102, 103, 104; 134/3; 148/247, 148/140, 142
See application file for complete search history.

(56) References Cited

U.S. PATENT DOCUMENTS

| | | | | |
|---|---|---|---|---|
| 4,176,433 | A | 12/1979 | Lee et al. | 29/156.8 B |
| 5,125,989 | A * | 6/1992 | Hallman | 148/247 |
| 5,242,544 | A * | 9/1993 | Itoh et al. | 216/49 |
| 5,813,118 | A | 9/1998 | Roedl et al. | 29/889.1 |
| 5,851,409 | A | 12/1998 | Schaeffer et al. | 216/2 |
| 5,989,476 | A * | 11/1999 | Lockard et al. | 264/401 |
| 6,024,858 | A * | 2/2000 | Nishino et al. | 205/139 |
| 6,165,345 | A | 12/2000 | Updegrove et al. | 205/717 |
| 6,265,022 | B1 | 7/2001 | Fernihough et al. | 427/142 |
| 6,544,460 | B2 | 4/2003 | Reed et al. | 264/267 |
| 6,599,416 | B2 | 7/2003 | Kool et al. | 205/717 |
| 6,695,587 | B2 | 2/2004 | Wustman et al. | 416/241 R |
| 6,758,914 | B2 | 7/2004 | Kool et al. | 134/28 |
| 6,793,738 | B2 | 9/2004 | Kool et al. | 134/3 |
| 6,833,328 | B1 | 12/2004 | Kool et al. | 438/745 |
| 6,863,738 | B2 | 3/2005 | Kool et al. | 134/3 |
| 6,953,533 | B2 | 10/2005 | Kool et al. | 216/109 |
| 2003/0098107 | A1 * | 5/2003 | Karabeyoglu et al. | 149/19.9 |
| 2004/0074873 | A1 | 4/2004 | Kool et al. | 216/109 |
| 2004/0169013 | A1 | 9/2004 | Kool et al. | 216/96 |
| 2008/0026674 | A1 * | 1/2008 | Cook | 449/2 |

* cited by examiner

*Primary Examiner*—Shamim Ahmed
(74) *Attorney, Agent, or Firm*—Hartman & Hartman, P.C.; Gary M. Hartman; Domenica N. S. Hartman

(57) ABSTRACT

A process for chemically stripping a metallic coating on an external surface of a substrate without attacking an internal surface defined by an internal passage within the substrate. Processing steps include depositing within the internal passage a thermally-decomposable wax having a melting temperature above 75° C. so as to mask the internal surface of the substrate, and then treating the substrate with an aqueous solution containing an acid having the formula $H_xAF_6$ where A is silicon, germanium, titanium, zirconium, aluminum, or gallium, and x has a value of one to six. The aqueous solution is at a temperature below the melting temperature of the wax and substantially removes the metallic coating from the external surface of the substrate, while the wax is substantially unreactive with the aqueous solution and prevents the aqueous solution from contacting the internal surface of the substrate. Thereafter, the substrate is heated to thermally decompose the wax without producing hazardous byproducts.

20 Claims, 1 Drawing Sheet

METHOD OF SELECTIVELY STRIPPING A METALLIC COATING

BACKGROUND OF THE INVENTION

This invention relates to methods of chemically removing coatings from surfaces of components, such as components exposed to the hot gas path of gas turbines and other turbomachinery. More particularly, this invention is directed to a method of masking regions of a component before chemically stripping a coating from the component with a $H_xAF_6$ acid-based stripping solution, where A is silicon, germanium, titanium, zirconium, aluminum or gallium, and x has a value of one to six.

The operating environment within a gas turbine is both thermally and chemically hostile. Significant advances in high temperature strength, creep resistance, and fatigue resistance have been achieved through the formulation of iron, nickel and cobalt-based superalloys. However, components in the hot gas path of a gas turbine, such as the buckets, nozzles, combustors, and transition pieces of an industrial gas turbine, are susceptible to oxidation and hot corrosion attack. Consequently, these components are often protected by an environmental coating alone or in combination with a ceramic thermal barrier coating (TBC), which in the latter case the environmental coating is termed a bond coat for the TBC. Components protected by an environmental coating or TBC system exhibit greater durability as well as afford the opportunity to improve efficiency by increasing the operating temperature of a gas turbine.

Environmental coatings and TBC bond coats are often formed of an oxidation-resistant aluminum-containing alloy or intermetallic whose aluminum content provides for the slow growth of a stable, adherent, and slow-growing aluminum oxide (alumina) layer (or scale) at elevated temperatures. Notable examples include diffusion coatings that contain aluminum intermetallics, predominantly beta-phase nickel aluminide and platinum-modified nickel aluminides (PtAl), and overlay coatings such as MCrAlX alloys (where M is iron, cobalt and/or nickel, and X is an active element such as yttrium or a rare earth or reactive element) or aluminide intermetallics (e.g., beta-phase and gamma-phase nickel aluminides). The alumina scale grown by these coatings protects the coatings and their underlying substrates from oxidation and hot corrosion and promotes chemical bonding of a TBC (if present). Diffusion aluminide coatings are formed by diffusion processes such as pack cementation, above-pack, and chemical vapor deposition techniques, and are characterized by an outermost additive layer containing an environmentally-resistant intermetallic represented by MAl, where M is iron, nickel, or cobalt, depending on the substrate material, and a diffusion zone beneath the additive layer and comprising various intermetallic and metastable phases that form during the coating reaction. Diffusion coatings are particularly useful for providing environmental protection to components with internal cooling passages, such as turbine buckets, because of their ability to provide environmental protection without significantly reducing the cross-sections of the passages due to the minimal thickness of the additive layer. In contrast, overlay coatings are predominantly an additive layer with limited diffusion zones as a result of the methods by which they are deposited, which include thermal spraying and physical vapor deposition (PVD) processes.

Though significant advances have been made with environmental coating, bond coat, and TBC materials and processes for forming such coatings, there is the inevitable requirement to repair or remove these coatings under certain circumstances. For example, removal may be necessitated by erosion or thermal degradation of an environmental coating or bond coat, refurbishment of the component on which the coating was deposited, or an in-process repair of the coating. Current state-of-the-art repair methods for removing ceramic and metallic coatings of the type used in TBC systems include grit blasting and treatments with an acidic stripping solution. The latter typically rely on lengthy exposures to the stripping solution, often at elevated temperatures, that can cause significant attack of the underlying metallic substrate, such as alloy depletion and intergranular or interdendritic attack. Furthermore, as in the case of the internal cooling passages of a turbine bucket, removal of an environmental coating is often undesirable and unnecessary. To selectively remove coatings from only those surface regions requiring refurbishment, masking materials are applied to those surfaces requiring protection from the stripping solution. As an example, to protect the interior passages of air-cooled turbine engine components, low-melting waxes and thermosetting resins such as plastisols have been injected into the cooling passages. An advantage of plastisol is, after curing at high temperature, its ability to withstand elevated temperatures used with acidic stripping solutions. After stripping the coatings from the unmasked surface regions, the masking material must be removed. In the case of low-melting waxes, removal of the masking material can be performed in a low temperature furnace. In contrast, plastisol requires a high temperature burn out that produces hazardous gases which must be scrubbed from the exhaust.

An improved acidic stripping solution disclosed in commonly-assigned U.S. Pat. No. 6,833,328 to Kool et al. is an aqueous solution containing an acid of the formula $H_xAF_6$ and/or precursors thereof, where A is silicon, germanium, titanium, zirconium, aluminum, or gallium, and x has a value of one to six. The stripping solution taught by Kool et al. may further contain one or more additional acids, such as nitric acid, a phosphorous-containing compound such as phosphoric acid, a mineral acid such as hydrochloric acid, etc. As taught in commonly-assigned U.S. Pat. Nos. 6,599,416, 6,758,914, 6,793,738, 6,863,738, and 6,953,533 and U.S. Patent Application Publication Nos. 2004/0074873 and 2004/0169013, the acidic solution of Kool et al. is effective to remove a variety of coating compositions, including diffusion aluminides, diffusion chromides, MCrAlX overlay coatings, and the oxide layers that grow on these coatings, without significantly attacking the substrate beneath these coatings. Another advantage of the Kool et al. solution is that, from an environmental standpoint, the $H_xAF_6$ acid is relatively benign in comparison to mineral acid-based compositions. Nonetheless, there are circumstances in which surfaces of a component being stripped with this solution are preferably protected. A notable example is the internal cooling passages of gas turbine components whose internal surfaces are protected with an environmental coating, particularly diffusion aluminide coatings, towards which the $H_xAF_6$ acid of Kool et al. is aggressive. However, low melting waxes cannot withstand treatment temperatures (typically about 80° C.) preferred for the $H_xAF_6$ acid stripping solution, and thermosetting resins such as plastisols are undesirable because of their requirement for a high temperature burn producing hazardous gases.

From the above, it would be desirable to provide a process by which a $H_xAF_6$-based acidic stripping solution can be prevented from attacking certain surface regions that are prone to attack from the solution.

BRIEF SUMMARY OF THE INVENTION

The present invention generally provides a process for chemically stripping a metallic coating on an external surface of a substrate without attacking an internal surface defined by an internal passage within the substrate. More particularly, the process prevents a $H_xAF_6$-based acidic solution from attacking certain surface regions that are prone to attack from the solution.

The processing steps of this invention generally include depositing within the internal passage a thermally-decomposable wax having a melting temperature above 75° C. so as to mask the internal surface of the substrate, and then treating the substrate with an aqueous solution at a temperature of at least 75° C. and containing an acid having the formula $H_xAF_6$ where A is silicon, germanium, titanium, zirconium, aluminum, or gallium, and x has a value of one to six. In doing so, the aqueous solution substantially removes the metallic coating from the external surface of the substrate, while the wax is substantially unreactive with the aqueous solution and prevents the aqueous solution from contacting the internal surface of the substrate. Thereafter, the substrate is heated to thermally decompose the wax without producing hazardous byproducts. As used herein, hazardous byproducts include compositions that are toxic to humans or the environment, as well as compositions that pose a fire or explosion risk.

In view of the above, an advantage of the present invention is the ability to use a $H_xAF_6$-based acidic solution, and particularly the solutions disclosed in U.S. Pat. No. 6,833,328 to Kool et al., to selectively strip metallic coatings from the exterior of a component without damaging a protective metallic coating within the interior of the component, as is the case with air-cooled gas turbine components whose interior cooling passages are protected with an environmental coating, such as a diffusion aluminide coating.

Other objects and advantages of this invention will be better appreciated from the following detailed description.

DETAILED DESCRIPTION OF THE INVENTION

Figure 1:
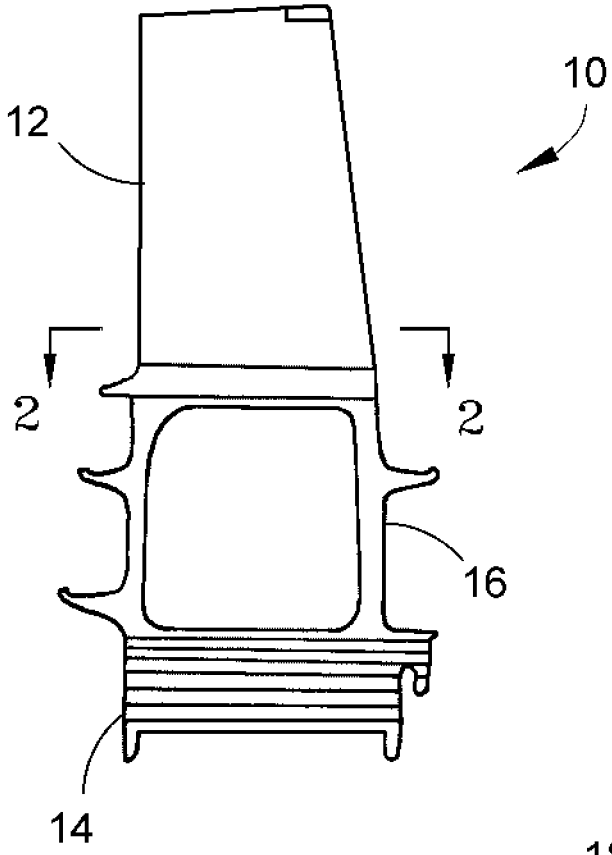
FIG. 1 is a side view of a gas turbine bucket of a type having an environmental coating on external surfaces that require removal and a second environmental coating on internal surfaces that does not require removal in accordance with a preferred stripping process of this invention.

The present invention is generally applicable to metal components that operate within environments characterized by relatively high temperatures, and are therefore subjected to a hostile oxidizing environment. Notable examples of such components include the buckets, nozzles, combustors, and transition pieces of industrial gas turbines. One such example is a bucket 10 depicted in FIG. 1. The bucket 10 generally includes an airfoil 12 and shank 16 that contact hot combustion gases during operation of the gas turbine, and whose surfaces are therefore subjected to severe attack by oxidation, corrosion and erosion. The airfoil 12 and shank 16 are anchored to a turbine disk (not shown) with a dovetail 14 formed on the shank 16. Various high-temperature materials can be used to form the bucket 10, notable examples of which include the commercially-known GTD-111, GTD-222, and GTD-444 nickel-based superalloys and the commercially-known FSX-414 cobalt-based superalloy. While the advantages of this invention will be described with reference to the bucket 10 shown in FIG. 1, the teachings of this invention are generally applicable to a variety of components on which an environmental coating may be used to protect the component from its environment.

The bucket 10 is preferably provided with some form of environmental and preferably thermal protection from its hostile operating environment. For this purpose, the exterior surfaces of the airfoil 12 and preferably those surfaces of the shank 16 facing the airfoil 12 are protected with a TBC system (not shown) that includes a ceramic TBC overlying an aluminum-containing bond coat, such as a diffusion coating or an overlay coating, each of which develops an oxide layer on its surface when exposed to the oxidizing environment within the hot gas path of a gas turbine. For additional thermal protection, the bucket 10 is provided with internal cooling passages 18 (FIG. 2) through which cooling air is forced to flow before exiting the bucket 10 at certain locations on the airfoil surface. The temperature within the internal cooling passages 18 can be sufficiently high to require an environmental coating, typically a diffusion aluminide coating, for oxidation protection.

The present invention is directed to a process for removing (or at least partially removing) the coating system on the exterior surfaces of the bucket 10 defined by the airfoil 12 and shank 16 without removing or damaging the environmental coating on the interior surfaces of the bucket 10 defined by the cooling passages 18. Removal of the coating system from the external surfaces of the bucket 10 is achieved by contacting these surface with the aqueous $H_xAF_6$-based stripping solution disclosed in commonly-assigned U.S. Pat. No. 6,833,328 to Kool et al., as well as commonly-assigned U.S. Pat. Nos. 6,599,416, 6,758,914, 6,793,738, 6,863,738, and 6,953,533 and U.S. Patent Application Publication Nos. 2004/0074873 and 2004/0169013, whose contents regarding the composition, preparation, and use of aqueous $H_xAF_6$-based solutions are incorporated herein by reference. As noted in these patents, the variable A in the acid formula is silicon, germanium, titanium, zirconium, aluminum, or gallium, and the variable x has a value of one to six. As reported in Kool et al., preferred levels for the $H_xAF_6$ acid in the aqueous solution will depend on various factors. Particularly suitable compositions for the solution contain the $H_xAF_6$ acid at levels of about 0.05 M to about 5 M, more preferably about 0.2 M to about 3.5 M, with fluosilicic acid ($H_2SiF_6$) being the preferred acid. When used as the only acid in the aqueous solution, the $H_xAF_6$ acid appears to be quite effective for removing diffusion and overlay coatings, such as diffusion aluminide coatings and MCrAlX overlay coatings, as well as the oxide layers that form on their surfaces without adversely affecting the underlying substrate. $H_xAF_6$ acids appear to be particularly useful in removing aluminide coatings, such as diffusion aluminides including platinum-modified diffusion aluminides.

As reported in Kool et al., the aqueous $H_xAF_6$ solution may optionally contain additional acids, such as phosphoric acid, nitric acid, sulfuric acid, hydrochloric acid, hydrofluoric acid, or mixtures thereof, as well as other acids disclosed in Kool et al. Use of additional acids are believed to enhance the removal of certain coating material from less accessible surface areas that are prone to depletion of the acidic solution during treatment. However, excessive amounts of such additives can result in the loss of selectivity and base metal attack. Phosphoric acid ($H_3PO_4$) is a particularly desirable additive at levels of about 0.1 M to about 0.5 M, more preferably about 0.2 M to about 0.4 M in the aqueous solution. The solution also preferably contains hydrochloric acid (HCl) at levels of about 0.02 M to about 0.1 M, more preferably about 0.03 M to about 0.06 M in the aqueous solution. A preferred composition for the aqueous solution has an acid content consisting of about 24 volume percent phosphoric acid (80% aqueous solution) and about 5 volume percent hydrochloric acid (37% aqueous solution), with the balance being the fluosilicic acid (23% aqueous solution).

As taught in Kool et al., the aqueous solution may be prepared using precursors of the $H_xAF_6$ acid as well as precursors of the additive acids. As such, various compounds or groups of compounds may be combined to form the acids or their anions, or which can be transformed into the acids or their anions. As such, the acids may be formed in situ in a vessel in which the stripping treatment is to take place. As an example, $H_2SiF_6$ can be formed in situ by the reaction of a silicon-containing compound with a fluorine-containing compound, such as silica ($SiO_2$) and hydrofluoric acid (i.e., aqueous hydrogen fluoride), respectively.

Also consistent with Kool et al., the aqueous composition may contain additives for various purposes, such as inhibitors, dispersants, surfactants, chelating agents, wetting agents, deflocculants, stabilizers, anti-settling agents, and anti-foam agents. For example, an inhibitor such as a relatively weak acid (e.g., acetic acid) can be included in the solution to lower the activity of the $H_xAF_6$ acid, for example, to decrease the potential for pitting of the substrate surface beneath the coating being stripped.

Various techniques can be used to treat the bucket 10 with the aqueous composition, such as spraying the surfaces of the bucket 10. More preferably, the bucket 10 is completely immersed in a bath of the aqueous solution to ensure contact between the solution and the coating being removed. Immersion time and bath temperature will depend on various factors, such as the type of coating being removed and the acid(s) present in the solution. A preferred bath temperature is about 80° C., with a suitable range being about 75° C. to about 85° C. though higher temperatures are also within the scope of this invention. Suitable immersion times are generally in a range of about ten minutes to about twenty-four hours, though shorter and longer immersions are foreseeable. While bath temperatures below 75° C. and as low as room temperature can be employed with the $H_xAF_6$ acid solution, the result can be the need for excessively long treatments to remove the coating.

To prevent attack of the environmental coating within the cooling passages 18 of the bucket 10 during stripping of the coating system on the external surfaces of the bucket 10, the present invention deposits within the internal passages 18 a thermally-decomposable wax 20 to mask the surfaces of the passages 18. To survive immersion in the bath of aqueous solution, the wax 20 must have a melting temperature above the temperature of the bath. Furthermore, the wax must be substantially unreactive with the aqueous solution and effectively coat and adhere to the surfaces of the passages 18 to prevent the aqueous solution from infiltrating the passages 18 and contacting the surfaces of the passages 18. In view of these considerations, a polyethylene (PE) wax (homopolymer) having a melting temperature above 75° C. and more preferably above 85° C. is believed to be a preferred material for the wax 20, though it is foreseeable that other thermally-decomposable wax materials with similar properties could be used in addition or instead. The above-noted polyethylene wax is preferred in part because it has a suitably high melting temperature and thermally decomposes at temperatures in a range of about 250° C. to about 500° C. without producing any hazardous byproducts. Notable examples of commercially-available PE wax homopolymers include the FILE-A-WAX® family of waxes (melting temperatures of about 240° F. (about 115° C.)), manufactured by the Ferris division of the Kindt-Collins Company LLC and available through various sources, such as Shor International Corporation. Byproducts of thermal decomposition of this PE wax homopolymer include shorter chain paraffins and carbon dioxide, which are nonhazardous.

Infiltration of the cooling passages 18 of the bucket 10 is achieved by heating the chosen wax above its melting temperature, and then allowed to flow into the passages 18 while the bucket 10 is heated to facilitate wax flow and filling. Following removal from the bath and heating to melt and thermally decompose the wax 20, the bucket 10 is preferably rinsed in water, which also may contain other conventional additives, such as a wetting agent.

Figure 2:
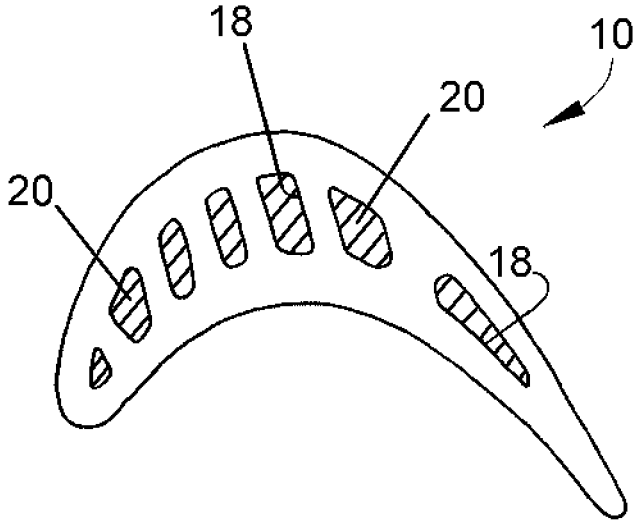
FIG. 2 is a cross-sectional view of the bucket of FIG. 1 along section line 2-2, and represents the placement of a masking wax to protect the environmental coating on internal cooling passages of the bucket during the stripping processing of this invention.

During an investigation leading to this invention, buckets essentially identical to that shown in FIGS. 1 and 2 underwent treatment with an aqueous stripping solution containing about 1 M $H_2SiF_6$, about 0.3 M phosphoric acid, and about 0.05 M hydrochloric acid. The buckets had been processed to have on their external airfoil surfaces an yttria-stabilized zirconia (YSZ) TBC over a CoCrAl bond coat commercially known under the name "PLASMAGUARD GT29," while their internal passage surfaces were coated with a diffusion aluminide coating. Prior to treatment with the aqueous stripping solution, the cooling passages of the buckets were filled with FILE-A-WAX® Blue, which had been heated to a temperature of about 125° C. so as to be molten. Prior to filling, the buckets were preheated in an oven and maintained at an elevated temperature during filling with a hot air gun to facilitate wax flow. After the wax was solidified, the buckets were grit blasted to remove their TBC's and cleaned (compressed air and ultrasonic treatments) to remove residue and debris from their external surfaces, followed by a rinse and approximately 24-hour total immersion in a bath of the above-noted solution at a temperature of about 80° C. Thereafter, the buckets were ultrasonically cleaned and the PE wax was removed by melting at about 125° C. followed by burnout at about 500° C. to completely remove residues of the wax by thermal decomposition.

At the completion of this process, all of the exposed bucket surfaces were free of remnants of the bond coat, while destructive evaluation of the buckets evidenced that the diffusion aluminide coatings on the internal surfaces of the cooling passages were completely intact and undamaged by the stripping solution. Based on these results, it is believed that the PE wax should be capable of withstanding extended exposures to the $H_xAF_6$-based acid solutions of Kool et al. without degradation that would result in attack of an underlying coating.

While the invention has been described in terms of particular embodiments, it is apparent that other forms could be adopted by one skilled in the art. Accordingly, the scope of our invention is to be limited only by the following claims.

What is claimed is:

1. A process of selectively stripping a metallic coating on an external surface of a substrate without attacking an internal surface defined by an internal passage within the substrate, the process comprising the steps of:

depositing within the internal passage a molten wax of a thermally-decomposable polyethylene wax having a melting temperature above 75° C.;

allowing the molten wax to cool and solidify to form a solid mask of the polyethylene wax within the internal passage and mask the internal surface defined by the internal passage;

treating the substrate with an aqueous solution at a temperature below the melting temperature of the polyethylene wax, the aqueous solution containing an acid having the formula $H_xAF_6$ where A is silicon, germanium, titanium, zirconium, aluminum, or gallium, and x has a value of one to six, the aqueous solution substantially removing the metallic coating from the external surface of the substrate, the polyethylene wax being substantially unreactive with the aqueous solution and preventing the aqueous solution from contacting the internal surface of the substrate; and then heating the substrate to melt the polyethylene wax and remove a portion thereof and then further heating the substrate to thermally decompose a remaining portion of the polyethylene wax without producing a hazardous byproduct.

2. The process according to claim 1, wherein the acid is fluosilicic acid and is present in the aqueous solution at a level of about 0.05 M to about 5 M.

3. The process according to claim 2, wherein the aqueous solution further contains phosphoric acid at a level of about 0.1 M to about 0.5 M in the aqueous solution.

4. The process according to claim 3, wherein the aqueous solution further contains hydrochloric acid at a level of about 0.02 M to about 0.1 M in the aqueous solution.

5. The process according to claim 1, wherein the acid is fluosilicic acid and the aqueous solution has an acid content consisting of about 24 volume percent phosphoric acid (80% aqueous solution) and about 5 volume percent hydrochloric acid (37% aqueous solution), with the balance being the fluosilicic acid (23% aqueous solution).

6. The process according to claim 1, wherein the temperature of the aqueous solution during the treating step is about 75° C. to about 85° C.

7. The process according to claim 1, wherein the metallic coating has an oxide layer on a surface thereof, and the aqueous solution substantially removes the oxide layer.

8. The process according to claim 1, wherein the substrate further includes a ceramic layer overlying the metallic coating.

9. The process according to claim 1, wherein the metallic coating is a diffusion coating.

10. The process according to claim 9, wherein the metallic coating contains an MAI intermetallic phase, where M is iron, nickel or cobalt.

11. The process according to claim 1, wherein the metallic coating is an aluminum-containing overlay coating.

12. The process according to claim 1, wherein the substrate is a superalloy surface region of a gas turbine component, the internal passage is a cooling passage of the component, and the internal surface is protected by a metallic environmental coating.

13. A process of selectively removing an environmentally-protective coating on an external surface of a superalloy airfoil component of a gas turbine without attacking internal surfaces defined by internal cooling passages within the component, the process comprising the steps of:

depositing within the internal cooling passages a molten wax of a thermally-decomposable polyethylene wax having a melting temperature above 85° C.;

allowing the molten wax to cool and solidify to form a solid mask of the polyethylene wax within the internal cooling passages that masks a metallic environmental coating on the internal surfaces defined by the internal cooling passages;

immersing the component in an aqueous solution at a temperature of at least 80° C. for a duration of at least ten minutes, the aqueous solution containing fluosilicic acid at a level of about 0.05 M to about 5 M in the aqueous solution to substantially remove the coating from the external surface of the component, the polyethylene wax being substantially unreactive with the fluosilicic acid and preventing the aqueous solution from contacting and removing the metallic environmental coating on the internal surfaces of the component; and then heating the component to melt the polyethylene wax and remove a portion thereof and then further heating tile component to thermally decompose a remaining portion of the polyethylene wax without producing a hazardous byproduct.

14. The process according to claim 13, wherein the aqueous solution further contains phosphoric acid at a level of about 0.1 M to about 0.5 M in the aqueous solution.

15. The process according to claim 14, wherein the aqueous solution further contains hydrochloric acid at a level of about 0.02 M to about 0.1 M in the aqueous solution.

16. The process according to claim 13, wherein the aqueous solution has an acid content consisting of about 24 volume percent phosphoric acid (80% aqueous solution) and about 5 volume percent hydrochloric acid (37% aqueous solution), with the balance being the fluosilicic acid (23% aqueous solution).

17. The process according to claim 13, wherein the coating has an oxide layer on a surface thereof, and the aqueous solution substantially removes the oxide layer.

18. The process according to claim 13, wherein the component further includes a ceramic layer overlying the coating.

19. The process according to claim 13, wherein the coating is a diffusion aluminide coating.

20. The process according to claim 13, wherein the coating is an aluminum-containing overlay coating.

* * * * *